US005461190A

United States Patent [19]

Terada

[11] Patent Number: 5,461,190

[45] Date of Patent: Oct. 24, 1995

[54] ELECTRONIC MUSICAL INSTRUMENT WITH AUTOMATIC ACCOMPANIMENT USING DESIGNATED REGIONS OF AUTOMATIC PERFORMANCE DATA

[75] Inventor: Kosei Terada, Hamamatsu, Japan

[73] Assignee: Yamaha Corporation, Hamamatsu, Japan

[21] Appl. No.: 156,396

[22] Filed: Nov. 22, 1993

Related U.S. Application Data

[63] Continuation of Ser. No. 842,432, Feb. 27, 1992, abandoned.

[30] Foreign Application Priority Data

Mar. 1, 1991 [JP] Japan ..... 3-036423

[51] Int. Cl.[6] ..... G10H 1/38; G10H 1/40

[52] U.S. Cl. ..... 84/609; 84/611; 84/613; 84/DIG. 12; 84/DIG. 22

[58] Field of Search ..... 84/609–614, 634–638, 84/DIG. 12 , DIG. 22

[56] References Cited

U.S. PATENT DOCUMENTS 4,481,853 11/1984 Ishikawa .
4,674,383 6/1987 Suzuki .
4,903,565 2/1990 Abe ..... 84/611
5,113,744 5/1992 Tanaka et al. ..... 84/634
5,239,124 8/1994 Eitaki et al. ..... 84/634

*Primary Examiner*—Stanley J. Witkowski
*Attorney, Agent, or Firm*—Spensley Horn Jubas & Lubitz

[57] ABSTRACT

In an electronic musical instrument, there is no creation of new automatic accompaniment data and the performer can carry out automatic accompaniment using favored optional automatic accompaniment data. The electronic musical instrument provides storage apparatus for storing automatic performance data, a designator for designating a fixed region of the automatic performance data and a automatic accompaniment apparatus which performs automatic accompaniment based on a pattern of the fixed region designated by the designator. Therefore, when the performer designates an optional region of the automatic performance data storage apparatus, automatic accompaniment of the patterns in the optional region designated by the automatic accompaniment apparatus using the designator is carried out.

20 Claims, 12 Drawing Sheets

ELECTRONIC MUSICAL INSTRUMENT WITH AUTOMATIC ACCOMPANIMENT USING DESIGNATED REGIONS OF AUTOMATIC PERFORMANCE DATA

This is a continuation of application Ser. No. 07/842,432 filed on Feb. 27, 1992, now abandoned.

BACKGROUND OF THE INVENTION

1. Field of the Invention

The present invention relates to an electronic musical instrument possessing an automatic accompaniment function and an automatic performance function. In particular, the present invention relates to an electronic musical instrument which uses a portion of the data created for the automatic performance for carrying out automatic accompaniment.

2. Prior Art

A conventional electronic musical instrument possessing an automatic accompaniment function is known and is described below.

1. The autobase code (hereafter referred to as ABC) patterns of such things as rhythm, bass, and codes are inserted into memory, read out, and then accompaniment is performed.
2. The pattern (custom pattern) suited to the performer's performance, is inputted in real time used by a manually operable unit, created, and then placed into memory: this is then read out and accompaniment is performed. Further details of this prior art can be referenced in Japanese Patent Application First Publication No. 61-292690 which discloses an electronic musical instrument previously proposed by the applicant of the present invention.

However, the automatic accompaniment function of the above-mentioned conventional electronic musical instrument, in the case of number 1, in order not to pass the reproduction of the patterns previously put into memory, has the drawbacks that change and taste are limited. Additionally, there are also drawbacks in the case in which the instrument does not suit the performer.

Additionally in the case of the above-mentioned number 2, optional patterns can be made; however, there are also drawbacks in that much time, labor and trouble are required since the performer must create the data for the automatic performance Just to make these optional patterns.

SUMMARY OF THE INVENTION

In consideration of the above, it is an object of the present invention to provide an electronic musical instrument that will minimize the time and labor required to create new accompaniment patterns and which can carry out automatic accompaniment utilizing optional accompaniment patterns suitable to the performer.

Consequently, the present invention provides a memorizing device in which is stored automatic performance patterns; a designator, for designating the sphere of the options of the automatic performance patterns; and an automatic accompaniment device for automatically accompanying the performer, which uses pattern options within the sphere designated by the designator. Through this type of instruction, when the performer utilizes the designator, the sphere of the automatic performance pattern options stored in memory is designated, and automatic accompaniment is performed by the automatic accompaniment device using pattern options within the sphere designated by the designator.

Therefore, by means of the present invention, a performer is able to designate a suitable sphere from among the automatic performance pattern data and uses this data to create accompaniment patterns. Consequently, there is no need to create new accompaniment patterns, and automatic accompaniment can be carried out using accompaniment pattern options favored by the performer.

DETAILED DESCRIPTION OF THE PREFERRED EMBODIMENT

Figure 1:
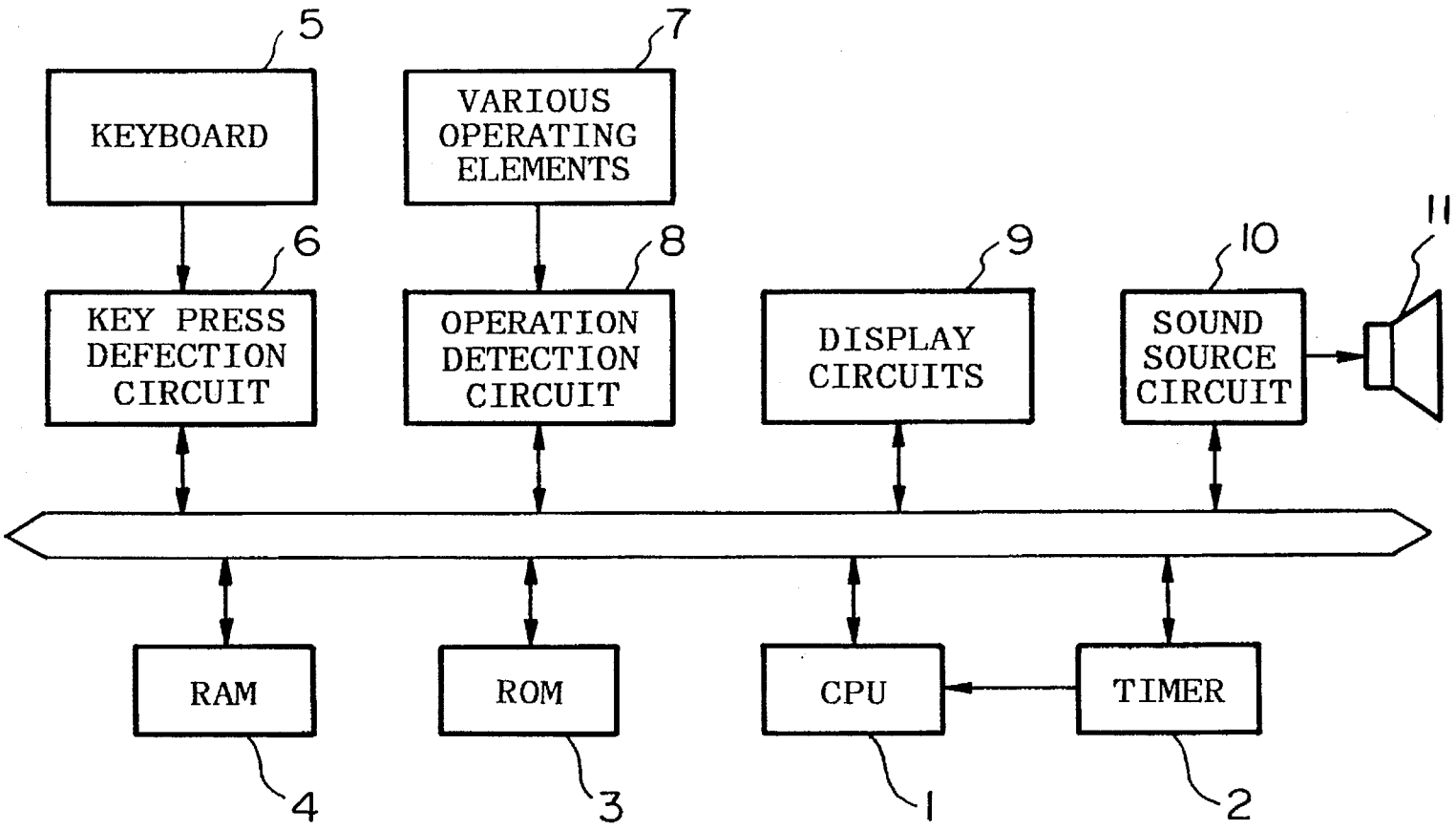
FIG. 1 shows a block diagram of an electrical structure of an electronic musical instrument according to the preferred embodiment of the present invention.
Figure 2:
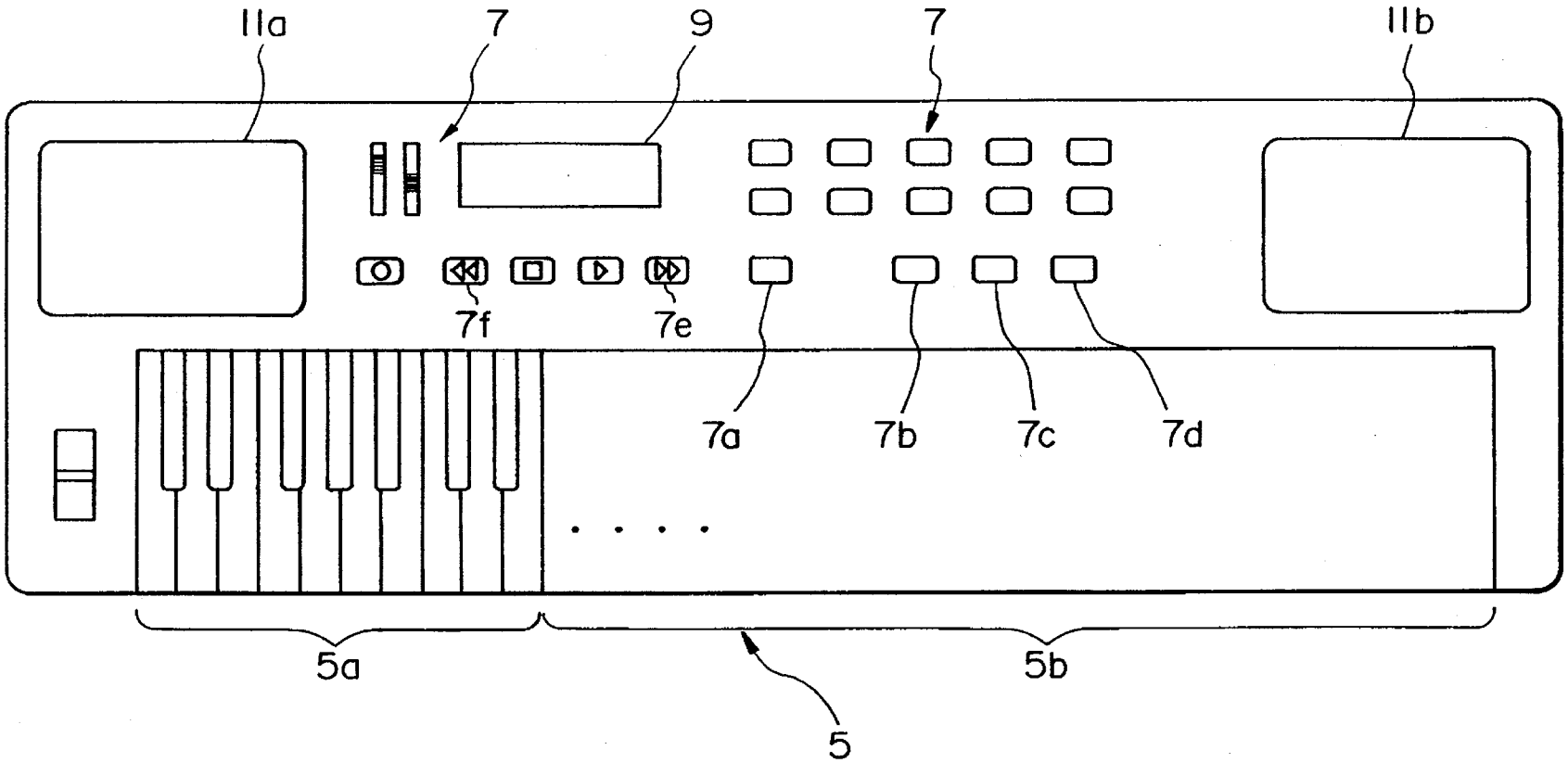
FIG. 2 is a front view showing the external structure of an electronic musical instrument according to the preferred embodiment of the present invention.

Hereinafter, an explanation of the preferred embodiment of the present invention is given by referring to the figures. FIG. 1 shows a block diagram of the electrical structure of the electronic musical instrument according to the preferred embodiment of the present invention, while FIG. 2 is a front view showing the external structure of the same electronic musical instrument according to the same preferred embodiment. In the figures, a central processing unit (CPU) 1, which controls all apparatuses, and a timer 2 are provided. In the timer 2, the timing data is set by the CPU 1, and each time the time period designated by the timing data lapses, a timer interruption pulse is supplied to the CPU 1. In the figures, ROM 3 which has stored a control program used in the CPU 1, and a RAM 4, are provided. Additionally, in the RAM 4, an automatic performance data area in which the data used for the automatic performance is stored and within which all types of registers, flags, and key-event buffers are maintained for use when the CPU 1 carries out any type of procedure.

Figure 3:
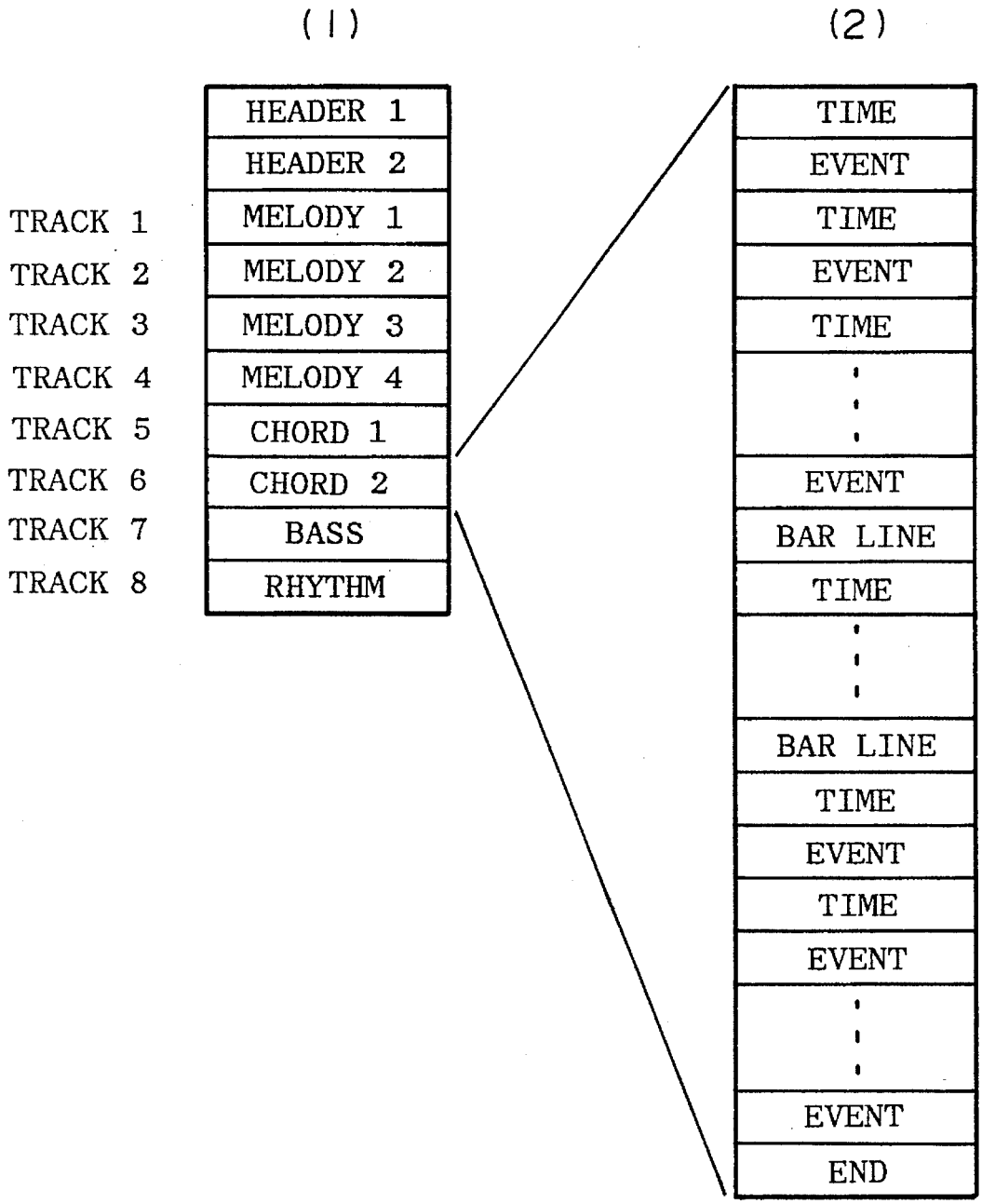
FIG. 3 shows an example structure of the data area used for automatic performance.

In FIG. 3, the structure of the automatic performance data area is shown. In FIG. 3, a header 1 is provided, which is employed during normal automatic performance, in which the data for the tempo, bar number, and tone color of the automatic performance are stored. Header 2 is employed during automatic accompaniment performance. This header 2 stores four start addresses and four end addresses, in addition to data such as bar number data. The four start addresses referred to above are each stored in one of four start address registers, start address register STADRS 1–4. Similarly, the four end addresses referred to above are each stored in one of four end address register, end address registers EDADRS 1–4. Multiple tracks which will be described further on also exist in memory, in each of which are multiple data areas containing various types of performance data. Among these data areas, that which contains data best suited for the type of automatic accompaniment to be carried out is addressed using the above mentioned start and end address. For a given automatic accompaniment pattern (hereafter ABC pattern), the location of the corresponding data area in a track is defined by a particular start address and end address between which the data area is located. Additionally, there are provided tracks 1–8: in tracks 1–4 the melody data for the 4 melodies 1–4 are stored. Furthermore, in tracks 5 and 6, chords 1 and 2 are stored, respectively; the base is stored in track 7, while rhythm is stored in track 8. However, among the aforementioned tracks 1–8, tracks 1–4 in which melodies 1–4 are stored, are not used in automatic accompaniment. In FIG. 3, (2) is an example of a data structure of chord 2 which is stored in track 6. In (2) of FIG. 3, the time and event of the data corresponding to 1 note in this group is given. The time is the time interval from the bar lines possessing the data showing the punctuation (the clock counts from the bar line); the event is the key-on note number and velocity data; while the end is the data indicating the termination of the data. Furthermore, the other tracks also have an identical data structure.

Additionally, in FIGS. 1 and 2, a keyboard 5, being made up of a plurality of keys, is shown. This keyboard is made up of an accompaniment key region 5*a*, the key region used for accompaniment, and a normal key region 5*b*, the key region which plays normal melodies. Consequently, the performer designates the root of the chord and the chord type such as the minor chord, the major chord, or the seventh chord by means of this accompaniment key region 5*a*. This designation can be either a single Finger chord which is designation by depressing some of the keys of constituent tones of the chord or a Finger chord which is designation by depressing all of the keys of constituent tones of the chord. In FIG. 1, a key-detection circuit 6 is provided which detects the operation of the keyboard 5 keys, and outputs the information corresponding to the key pressed. Various operating elements 7 comprises a rhythm start-stop switch 7*a*, an automatic accompaniment pattern production switch 7*b*, a start switch 7*c*, an end switch 7*d*, a fast-forward FF switch 7*e*, and a rewind REW switch 7*f*. Hereinafter, the function of each operating element will be explained.

An operation detection circuit 8 is provided which detects the operation of each operating element of the various operating elements 7, and outputs the operation information corresponding to each respective operating element. Additionally, there are provided a display circuit 9, formed from a liquid crystal display; a sound source circuit 10, which outputs musical tone signals and is controlled by CPU 1; a sound system 11, which inputs the musical tone signal outputted from the sound source circuit 10, and generates the musical tone; and formed from an amplifier, speakers 11*a* and 11*b* and the like.

Next the flow of operation in the electrical musical instrument of the present invention will be described with reference to the flow charts of FIGS. 4–12.

Figure 4:
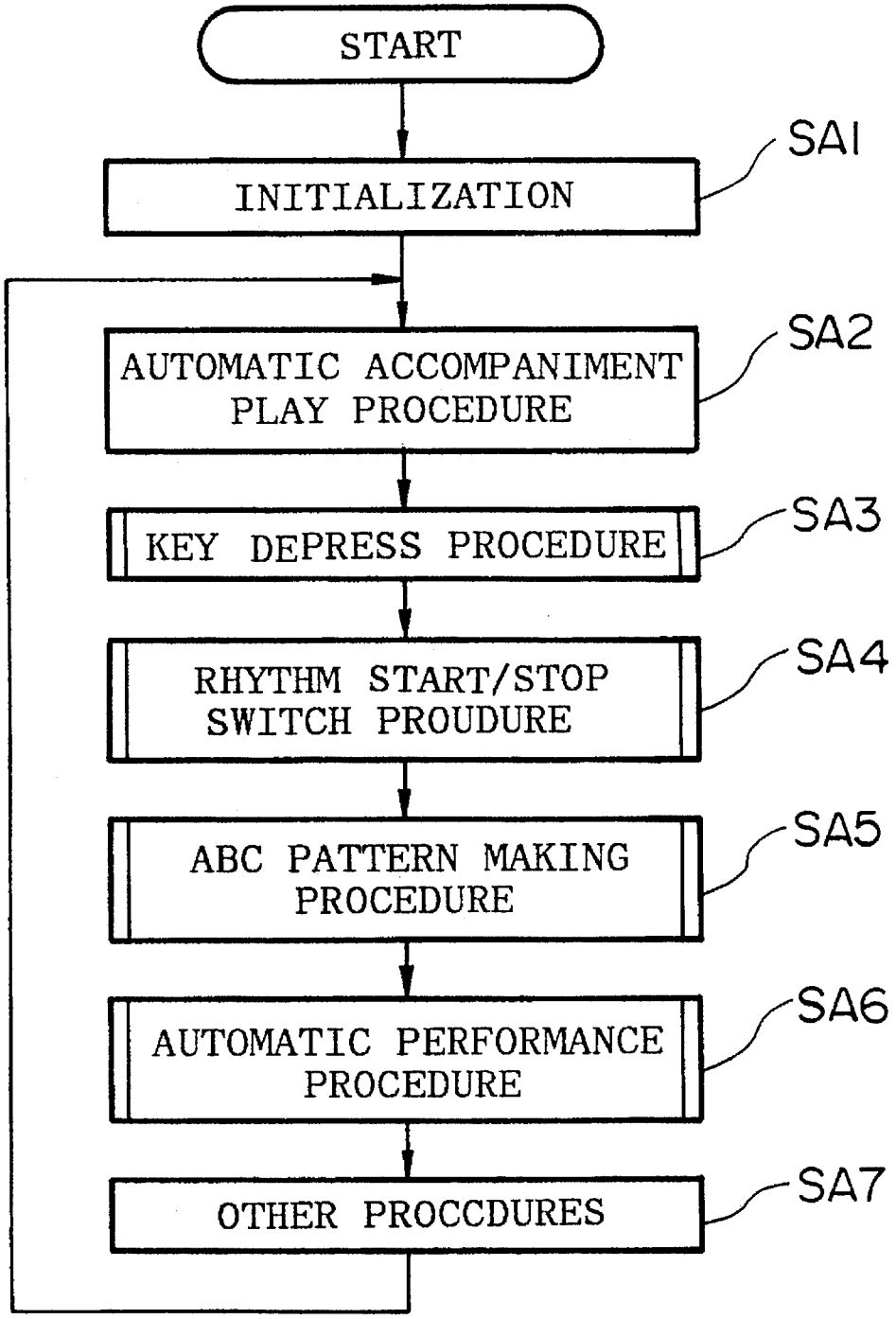
FIGS. 4 through 12 are flow charts showing the CPU 1 movements.

When power is supplied to the device shown in FIG. 1, CPU 1 begins to execute the initialization routine shown in FIG. 4 starting with step SA1. This initialization consists of the setting of the initial tone color in the sound source circuit 10, and the clearing of the register of RAM 4. Next, the automatic performance play procedure is carried out in step SA2. The automatic performance play procedure is that the automatic performance pattern stored in RAM 4 is read and automatic performance processing is carried out using the automatic performance pattern. Since this automatic performance procedure is well-known, a detailed explanation of the procedure will be omitted.

Figure 5:
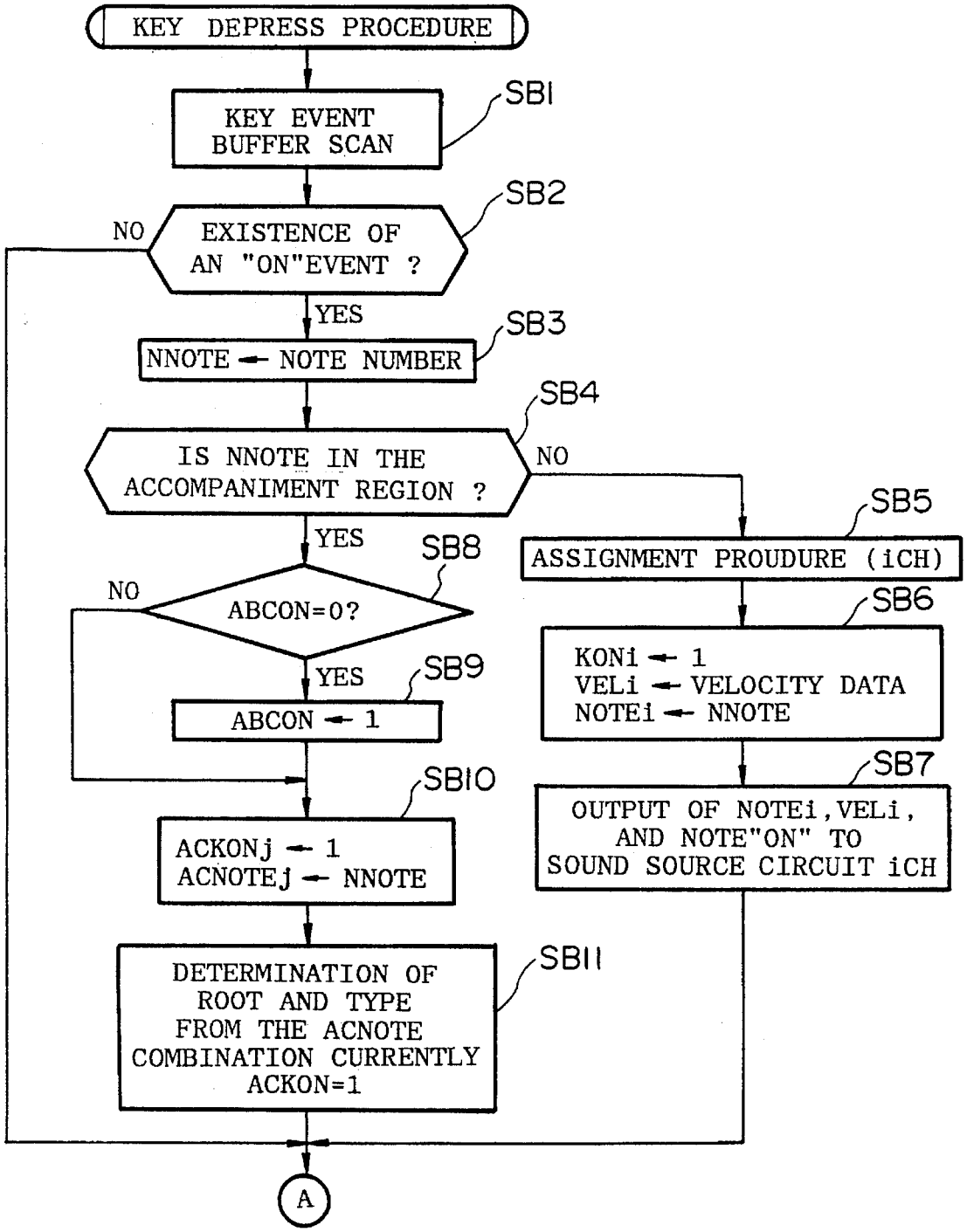
Figure 6:
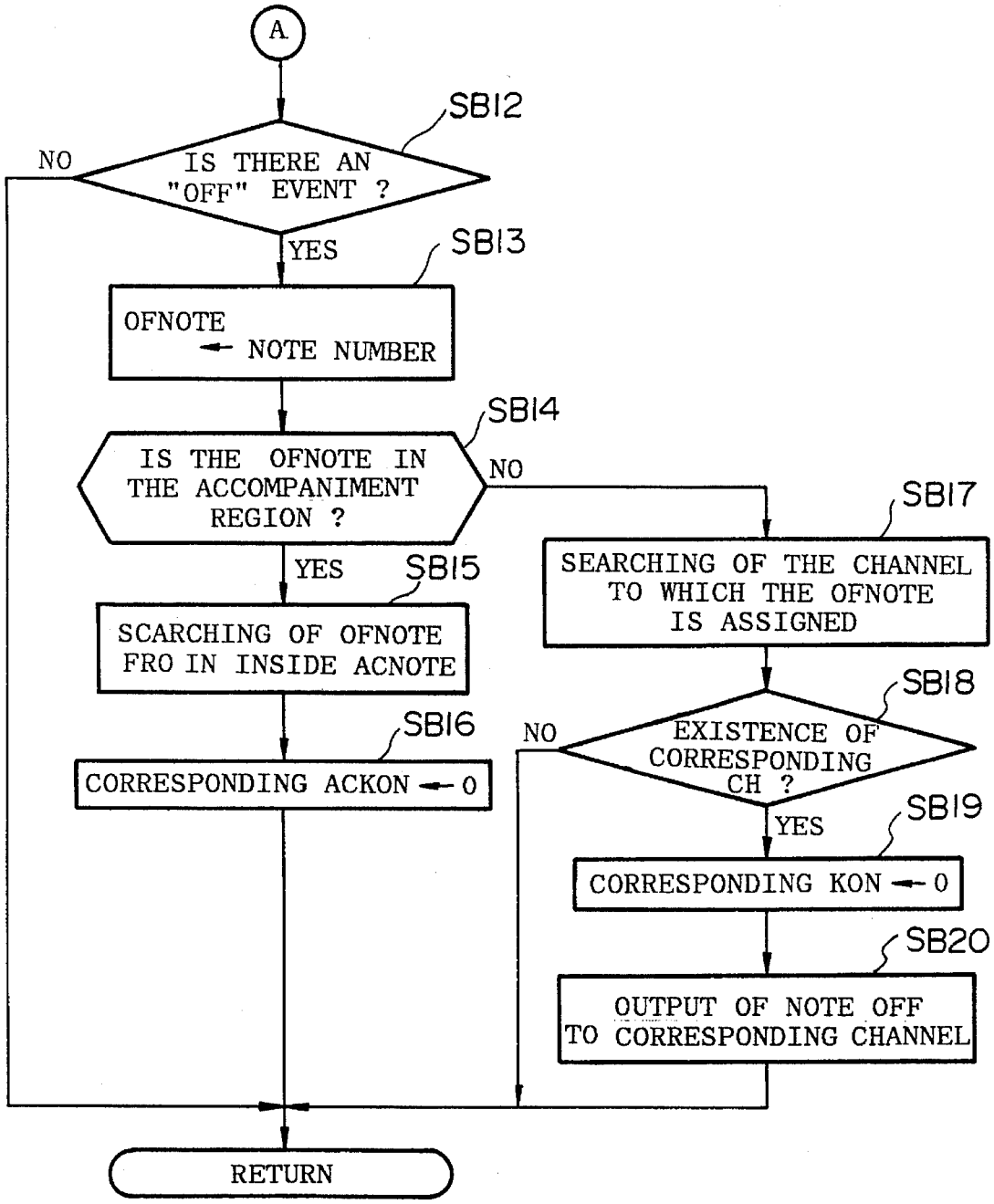
Figure 7:
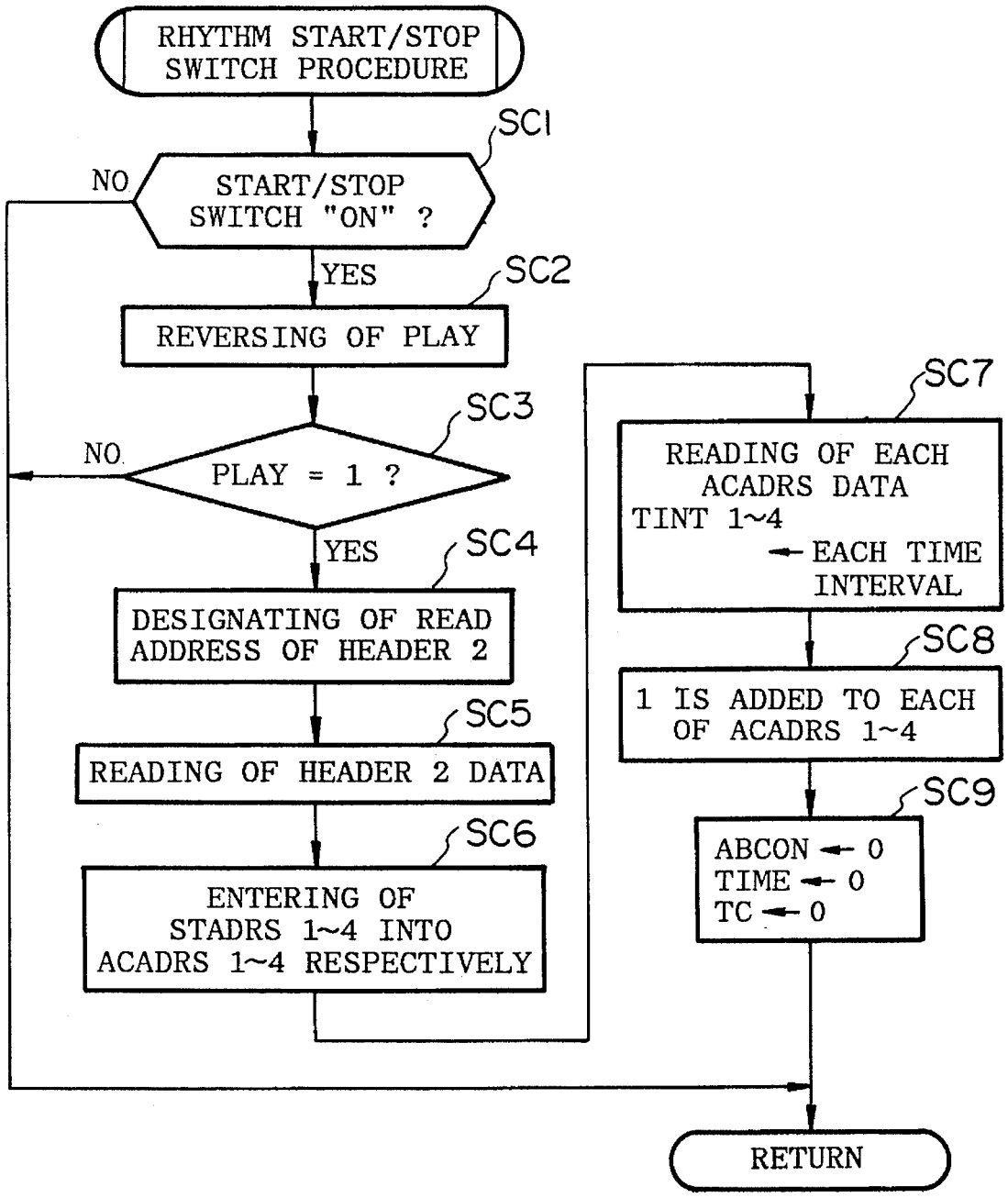

Next, in step SA3, when at least one of the keys on keyboard 5 is pressed or released, the key press procedure is performed. The routine of this procedure is shown in FIGS. 5 and 6. In this routine, in step SB1, the key event buffer maintained inside of RAM 4 is scanned. In this key event buffer, the key event generated during one round of the main routine procedure is stored Next, in Step SB2, judgment is made as to whether or not there exists an ON event. When the result of the judgment in SB2 is [NO], that is, an ON event does not exist, the routine proceeds to step SB12, without the carrying out of the ON event procedures outlined in steps SB3–11 below.

In contrast, when the results of the Judgment in step SB2 is [YES], in other words when an ON event does exist, the routine proceeds to step SB3. In step SB3, the key note number possessing the ON event is stored in register NNOTE, which indicates the new note number. In step SB4, judgment is made as to whether or not the note number stored in register NNOTE is a key note number in the accompaniment key region 5*a* of the keyboard 5. When the result of the judgment in SB4 is [N0], that is, the note number stored in register NNOTE is a key note number in the normal key region 5*b* of the keyboard 5, in order to process sounding a melody sound based on the key note number, the routine proceeds to step SB5.

In step SB5, a channel assignment procedure is carried out, in which the sound of the key turned on is assigned to the open channel (iCH) in which sound processing is not being carried out among the plurality of channels in sound source circuit 10. Next, in step SB6, the key-on flag KONi, which indicates the switching on of iCH, is set to [1]. Together with this, the velocity data of the key turned on in the register VELi, storing the velocity data of ICH, and the note number stored in register NNOTE, are both stored in the register NOTEi, which stores the note number of iCH.

In step SB7, the data and the note on data stored respectively in registers NOTEi and VELi in iCH of the sound source circuit 10 are outputted, and the routine proceeds to step SB12 shown in FIG. 6. In contrast, when the result of the judgment in step SB4 is [YES], that is, when the note number stored in register NNOTE is a key note number in the accompaniment region 5*a* of keyboard 5, the routine proceeds to step SB8.

In step SB8, whether or not ABC on-flag ABCON is being cleared to [0]is determined. This flag ABCON, is cleared to [0] when the performer starts the rhythm by means of the rhythm start/stop switch 7*a* (FIG. 2), one of the various operating elements 7 in the rhythm start/stop switch procedure as described below. When the result of the judgment in step SB9 is [YES], the routine proceeds to step SB9.

In step SB9, flag ABCON is set to [1]. The procedure of the step SB9 is carried out because the accompaniment does not commence with just the starting of the rhythm by the performer by means of the rhythm start/stop switch 7*a*, and the chord and base of the accompaniment are not added to the performance until the pressing of keys is carried out by the performer. Following this, the routine proceeds to step SB10. And, when the result of the judgment in step SB8 is [NO], or in other words flag ABCON has already been set to [1], the routine proceeds straight to step SB10. In SB10, when one of the plurality of key-on flags ACKON for use in automatic accompaniment, which has been cleared to [0](for example, J) is set to [1], the note number (the key note number now on) stored in register NNOTE is stored in register ACNOTEj which stores the corresponding note number for automatic accompaniment.

In step SB11, note root NROOT and type TYPE, taken from the combination of note numbers stored in register ACNOTE corresponding to all of the flags ACKON currently being set to [1] among the plurality of flags ACKON, are referenced and determined from a table not shown in the figures.

In step SB12 shown in FIG. 6, Judgment is made as to whether or not there is an off-event. When the result of the Judgment in step SB12 is [NO], or in other words when there is no off-event, the routine returns to step SA4 of the main routine shown in FIG. 4, without performing the off-event procedure outlined below in steps SB13–20. Conversely, when the result of Judgment in step SB12 is [YES], that is, when there exists an off-event, the routine proceeds to step SB13.

In step SB13, the key note number possessing the off-event is stored in the register OFNOTE, which indicates the key-off note number. In step SB14, judgment is made as to whether or not the note number stored in register OFNOTE is a key note number in the accompaniment region 5*a* of the keyboard 5. When the result of the judgment in step SB14 is [YES], that is, when the note number stored in register OFNOTE is a key note number in the accompaniment region 5*a* of the keyboard 5, in order to silence the accompaniment sound, the routine proceeds to step SB15.

In step SB15, there are searched the note numbers stored in registers OFNOTE from among the note numbers for use in automatic accompaniment stored in a plurality of registers ACONT. Next, in step SB16, the flag ACKON corresponding to the note number searched, is cleared to [0]. Thereby, the key released in the above-mentioned step SBll, namely the key which reset flag ACKON to [0], has no relation to the outcome of the root chord ROOT and type TYPE. Thus, the routine returns to the main routine in FIG. 4, and proceeds to step SA4.

In contrast, when the result of Judgment in step SB14 is [NO], or in other words when the note number stored in register OFNOTE is a key note number in the normal region 5*b* of keyboard 5, in order to proceed with the silencing of melody sounds, the routines proceeds to step SB17. In step SB17, the channel CH of sound source circuit 10, which assigns the key corresponding to the note number stored in register OFNOTE, is searched. In step SB18, judgment is made as to whether or not the aforementioned channel CH is in sound source circuit 10. When the result of the judgment in step SB18 is [YES], the routine proceeds to step SB19. In step SB19, flag KON, corresponding to the note number stored in register OFNOTE, is cleared to [0].

In step SB20, the note-off data is outputted to the aforementioned channel of sound source circuit 10, and the routine returns to the main routine shown in FIG. 4, proceeding to step SA4. On the other hand, when the result of judgment in step SB18 is [NO], that is, when the aforementioned channel CH is not in sound source circuit 10, the routine returns to the main routine shown in FIG. 4, proceeding to step SA4. In the case of this result, for example, the sounds have already been silenced by means of the truncated procedure which is performed in the aforementioned procedures of steps SB5–7, shown in FIG. 5. In step SA4, the on-event of the rhythm start/stop switch 7*a* (see FIG. 2) among the various operation elements 7, is detected and processed in the rhythm start/stop procedure. The routine of this procedure is outlined in FIG. 7. In this routine, in step SC1, judgment is made as to whether or not the rhythm start/stop switch 7*a* is "on". When the result of Judgment in step SC1 is [NO], that is, when the rhythm start/stop switch 7a is not "on", the rhythm start/stop procedure outlined in steps SC2–9 below, is not carried out, and the routine returns to the main routine in FIG. 4, and proceeds to step SA5.

In contrast, when the result of judgment in step SC1 is [YES], or in other words when the rhythm start/stop switch 7*a* is "on", the routine proceeds to step SC2. In step SC2, there is reversal of the condition of the rhythm play flag PLAY, which has been set to [1] during performance of rhythm. Specifically, when the flag PLAY has been set to [1], it is cleared to [0]; in contrast, when this flag PLAY has been cleared to [0], it is set back to [1]. In the starting condition, the flag PLAY has been cleared to [0], thus changing from [0] to [1].

In step SC3, in order to judge whether or not rhythm start has been designated by the performer, Judgment is made as to whether or not the flag PLAY has been set to [1]. When the result of judgment in step SC3 is [NO], or in other words when flag PLAY has been cleared to [0], it means that the rhythm start/stop switch 7*a* is pushed on in the play state, and the routine returns to the main routine in FIG. 4, and proceeds to step SAS.

In contrast, when the result of Judgment in step SC3 is [YES], that is, when the flag PLAY has been set to [1], it means that the rhythm start/stop switch 7*a* is pushed on in the stop state. Therefore, in order to carry out the establishment of the rhythm start, the routine proceeds to step SC4. In step SC4, the lead address of header 2 (header address) of the automatic accompaniment data area in FIG. 3 is designated. Next, in step SC5, the data stored in header 2 is read and various settings are performed. In step SC6, four start addresses, to be entered into registers STADRS 1–4 which are prepared in header 2 in the ABC pattern making procedural routine mentioned below, are entered into registers ACADRS 1–4 which store the addresses for use in automatic accompaniment. Following this, the routine proceeds to step SC7.

In step SC7, with the values stored in registers ACADRS 1–4, the data corresponding to the addresses of the automatic accompaniment data area, namely the time intervals, are read out, and are entered into time interval registers TINT 1–4, respectively. Next, in step SC8, each of the values in registers ACADRS 1–4 are incremented by 1. In step SC9, flag ABCON, explained in the above-mentioned key pressing procedure routine, is cleared to [0]. Therefore, the rhythm is outputted at the beginning, but the chord and bass are not added. Additionally, register TIME (in the automatic accompaniment procedure routine mentioned hereinafter judgment is made as to whether or not there is timing in the rhythm and such to be played, based on the value of this register TIME), in which is stored the clock counted from the beginning bars, is cleared to [0]. Together with this, the register TC, which stores the tempo clock, is cleared to [0], and the routine returns to the main routine in FIG. 4, proceeding to step SA5.

Figure 8:
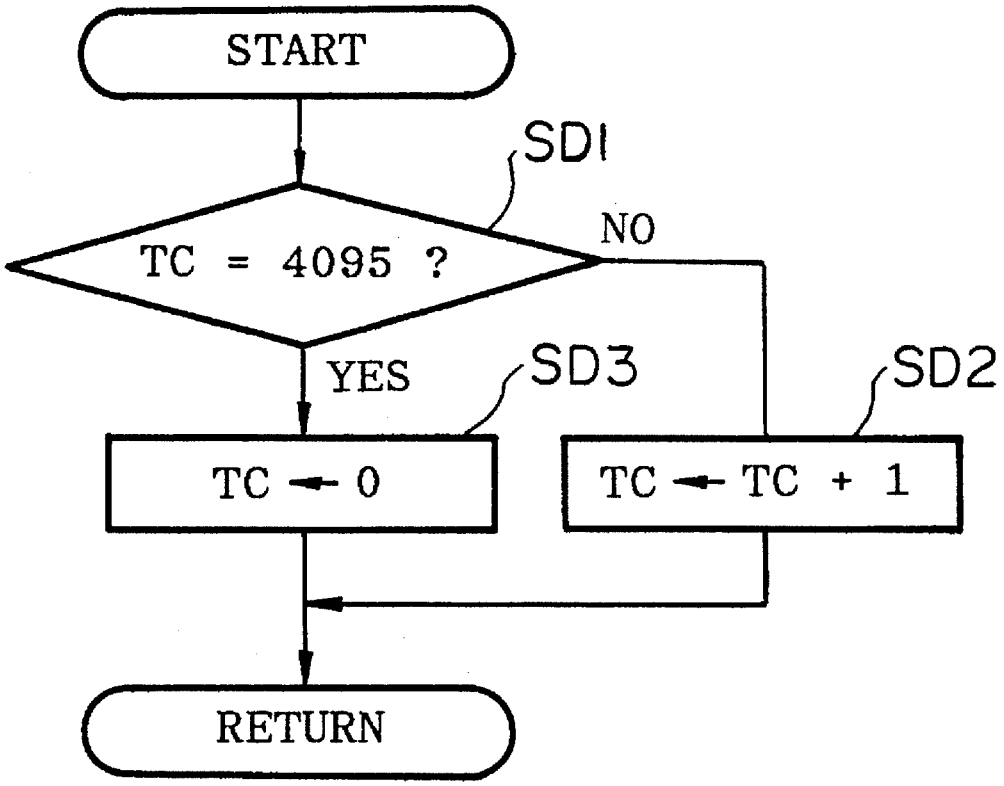

In the following, the tempo clock will be explained. The tempo clock is incremented by means of a timer interruption procedure which is performed at a set cycle in response to the tempo. The routine of this timer interruption procedure is shown in FIG. 8. In this routine, in step SD1 judgment is made as to whether or not the value of register TC, which is a 12-bit register, has reached 4095 because overflow of register TC is prevented. When the result of Judgment in step SD1 is [NO], or in other words when the value of register TC is not 4095, the routine proceeds to step SD2.

In step SD2, after the value of register TC is incremented by 1, the routine returns to the main routine in FIG. 4. In contrast, when the result of Judgment in step SD1 is [YES], namely when the value of register TC is 4095, the routine proceeds to step SD3. In step SD3, after the value of register TC has been reset to [0], the routine returns to the main routine in FIG. 4.

Figure 9:
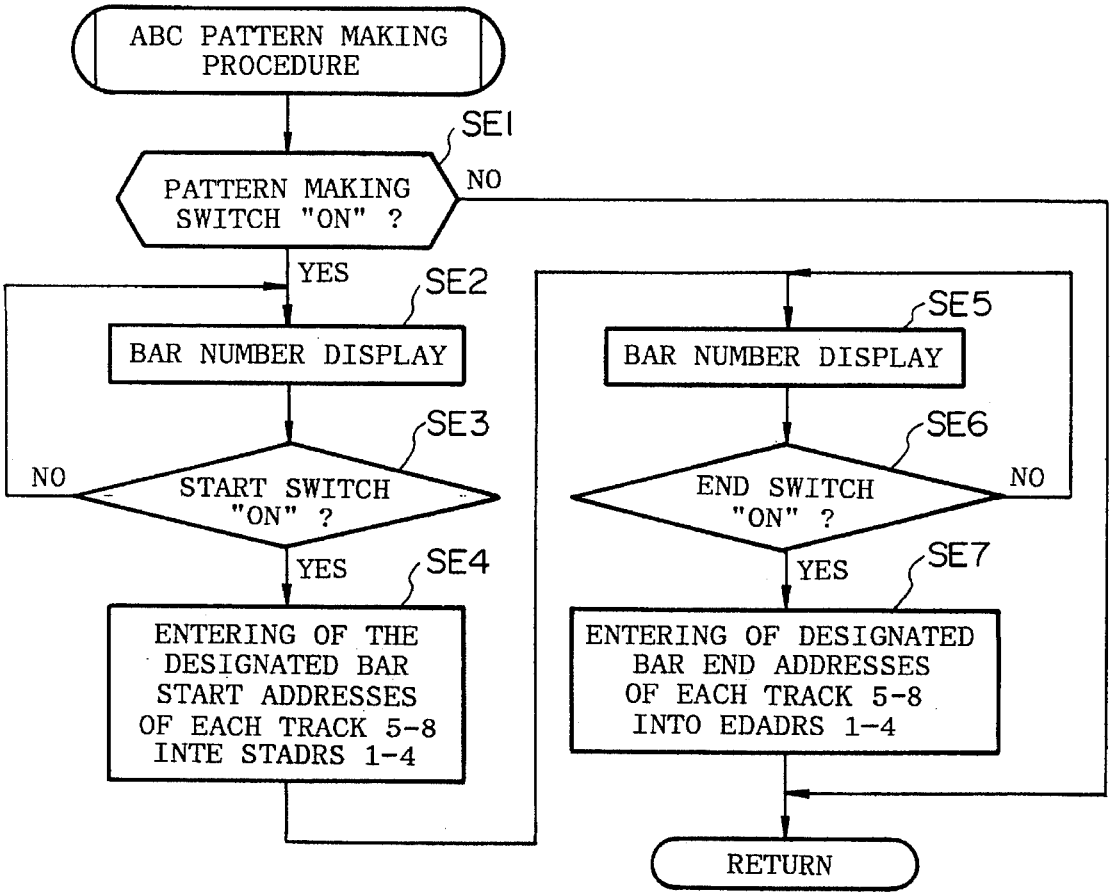

In step SAS, in response to the operation of the various operating elements 7 by the performer, an ABC pattern making procedure is performed which designates the data area for use in automatic accompaniment from among the automatic accompaniment data stored in 4. The routine of this procedure is shown in FIG. 9. In this routine, in step SE1 judgment is made as to whether or not the automatic accompaniment pattern making switch 7*b*, shown in FIG. 2, is "on". When the result of the judgment in step SE1 is [NO], that is, the automatic accompaniment pattern making switch 7*b* is not "on", the routine returns to the main routine in FIG. 4, proceeding to step SA6.

In contrast, when the result of Judgment in step SE1 is [YES], or in other words, the automatic accompaniment pattern making switch 7*b* is "on", the routine proceeds to step SE2. In step SE2, in response to the operation of FF switch 7*e* and REW switch 7*f* (shown in FIG. 2) by the performer, the bar numbers of the automatic accompaniment data stored in RAM4 are displayed in display circuit 9 in order. Next, in step SE3 judgment is made as to whether or not start switch 7*c* in FIG. 2 is "on". When the result of the judgment in step SE3 is [NO], the routine returns to step SE2. In other words bar numbers continue to be displayed in the display circuit 9 until the start switch 7*c* is pushed.

In contrast, when the result of Judgment in step SE3 is [YES], that is, the start switch 7*c* is "on", the routine proceeds to step SE4. In step SE4, the start addresses of the bars, designated for tracks 5–8 respectively, are entered into start address registers STADRS 1–4, which are prepared in the header 2 of the automatic accompaniment data area of RAM 4 (see FIG. 3 (1)). In step SE5, in response to the operation of FF switch 7E or REW switch 7*f* by the performer, the bar numbers of the automatic accompaniment data are displayed in display circuit 9 in order. Next, in step SE6 judgment is made as to whether or not end switch 7*d* in FIG. 2 is "on". When the result of judgment in step SE6 is [NO], the routine returns to step SES. IN other words bar numbers will continue to be displayed in the display circuit 9 until end switch 7*d* is turned "on".

In contrast, when the result of Judgment in step SE6 is [YES], or in other words when end switch 7*d* is "on", the routine proceeds to step SE7. In step SE7, the bar end addresses designated for tracks 5–8 are entered Into each of end address registers EDADRS1–4, which are prepared in header 2 of the automatic accompaniment data area of RAM4 (see FIG. 3 (1)). Following this, the routine returns to the main routine shown in FIG. 4, proceeding to step SA6.

Figure 10:
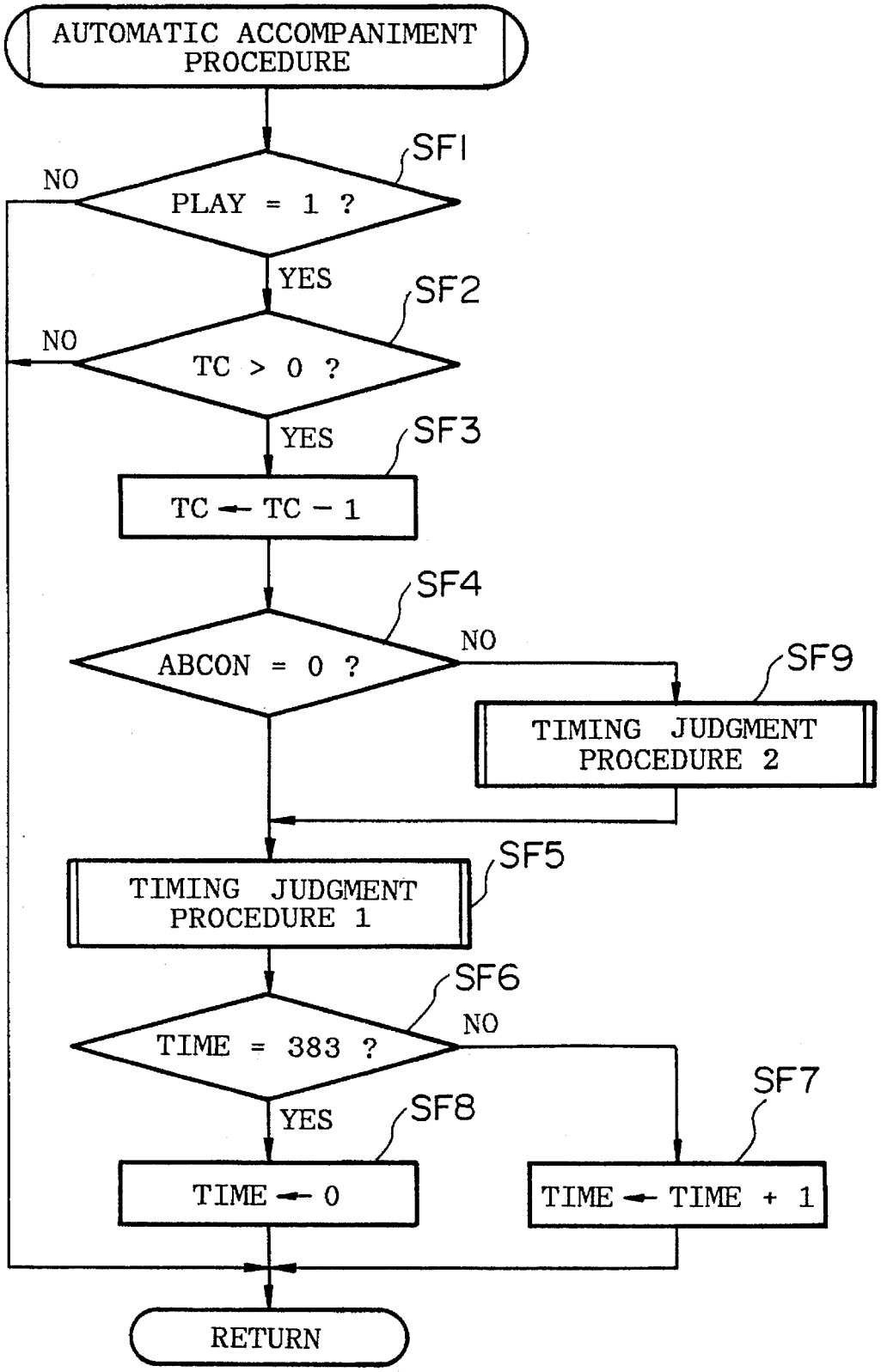

In step SA6, the automatic accompaniment procedure, which reads the ABC pattern and outputs the performance sounds, is performed. The routine of this procedure is shown in FIG. 10. In this routine, in step SF1 judgment is made as to whether or not flag PLAY has been set to [1]. When the result of judgment in step SF1 is [NO], or in other words flag PLAY has been cleared to [0], the routine returns to the main routine in FIG. 4 and proceeds to step SA7. In the above-described way, when the rhythm start/stop switch 7*a* is "on", the state of this flag PLAY reverses consequently, until both the rhythm start/stop switch 7*a* has been pushed by the performer and flag PLAY has been set to [1], an automatic accompaniment procedure cannot be carried out.

Therefore, when rhythm start/stop switch 7*a* is pushed by the performer and flag PLAY is set to [1], the result of judgment in step SF2 becomes [YES], and the routine proceeds to step SF2. In step SF2 judgment is made as to whether or not the value of register TC, namely the value of the tempo clock, is greater than 0. When the result of judgment in step SF2 is [NO], that is, the value of the tempo clock is 0, the routine returns to the main routine in FIG. 4 and proceeds to step SA7.

In contrast, when the result of judgment in step SF2 is [YES], or in other words when the value of the tempo clock is greater than 0, the routine proceeds to step SF3. In step SF3, the value of register TC is decremented by 1. In the following, the above-described procedures in steps SF2 and SF3 will be explained, because the space of the timer interruption does not correspond to the cycle of the main routine, these procedures are designed to allow performance of only one cycle of the procedure of the main routine in response to the occurrence of one round of the interruption procedure.

For example, during the interval from one timer interruption to the next timer interruption the procedure of the main routine may be performed a plurality of times. If the value of register TC becomes 1 by which the value of register TC increases by 1 by one timer interruption, at the beginning of the main routine following this timer interruption, the result of Judgment in step SF2 becomes [YES]. Therefore, in step SF3, after the value of register TC has been decremented by 1, the procedure in step SF4 is performed thereafter.

Therefore, when the automatic accompaniment procedure of the main routine is performed the next time, because the value of register TC is decremented by 1 at the preceding procedure of step SF3, the value of register TC has been 0. Consequently, the result of Judgment in step SF2 becomes [NO], and the automatic accompaniment procedure in step SF3 is not thereafter performed. After this, until the timer interruption occurs, in the same way as above, as a result of the automatic accompaniment procedure not being carried out following step SF3, the automatic accompaniment procedure of the main routine is performed only once corresponding to one occurrence of the timer interruption. Following this, the routine proceeds to steps SF4.

In step SF4 judgment is made as to whether or not ABC on-flag ABCON has been cleared to [0]. When the performer starts the rhythm by means of rhythm start/stop switch 7*a* in the above-described rhythm start/stop switch procedure (see FIG. 7), this flag ABCON is at first cleared to [0]. However, when the performer pushes at least one of the keys in the accompaniment region 5*a* of the keyboard 5, this flag ABCON is set to [1]. Consequently, until the performer performs a key press, the result of judgment in step SF4 is [YES], and step SF5 is proceeded to.

In step SF5, a timing judgment procedure 1, which creates rhythm, is performed. This procedure will be described hereinafter. The routine then proceeds to step SF6.

In step SF6 judgment is made as to whether or not the value of register TIME, explained in the above-described rhythm start/stop switch procedure routine, is equal to 383. When the result of the judgment in step SF6 is [NO], namely the value of register TIME does not equal 383, step SF7 is proceeded to.

In step SF7, after the value of registers TIME has been incremented by one, the main routine in FIG. 4 is returned to, proceeding to step SA7.

However, when the result of judgment in step SF6 is [YES], or in other words, the value of register TIME equals 383, step SF8 is proceeded to. In step SFS, after the value of register TIME is cleared to [0], the main routine in FIG. 4 is returned to, proceeding to step SA7.

In the following, the procedures of the above-described steps SF6–8 will be explained. In the present embodiment, since there are 96 clock pulses in a quarter note, after the value of register TIME has been cleared to [0] in the procedure of step SC9 in the above-described rhythm start/stop switch procedure routine, the 383 clock pulses result from the elapse of time equal to one bar, namely 4 quarter notes.

In the present embodiment, as a result of the timing data in the automatic accompaniment data being expressed in the timing of one bar, normally the values of register TIME in the procedures of steps SF6–8 are incremented by 1, When the time equivalent to one bar elapses, a process is carried out which provides for the reading of the automatic accompaniment data of the next bar, and which clears register TIME to [0]. However, the case is assumed in which 4/4 measures exist.

Additionally, when the result of judgment in step SF4 is [NO], namely, when the performer has pressed at least one of the keys in the accompaniment region 5*a*, ABC on-flag ABCON is set to [0], and step SF9 is proceeded to. In step SF9, a timing judgment procedure 2, which creates chords and bass, is performed. Details relating to this procedure will be stated hereinafter. The routine then goes to step SF5.

Additionally, when the result of judgment in step SF2 is [NO], or in other words, when the value of register TC is 0, the main routine in FIG. 4 is returned to, proceeding to step SA7. In step SA7 of FIG. 4, after a procedure other than those mentioned above is performed, step SA2 is returned to.

Figure 11:
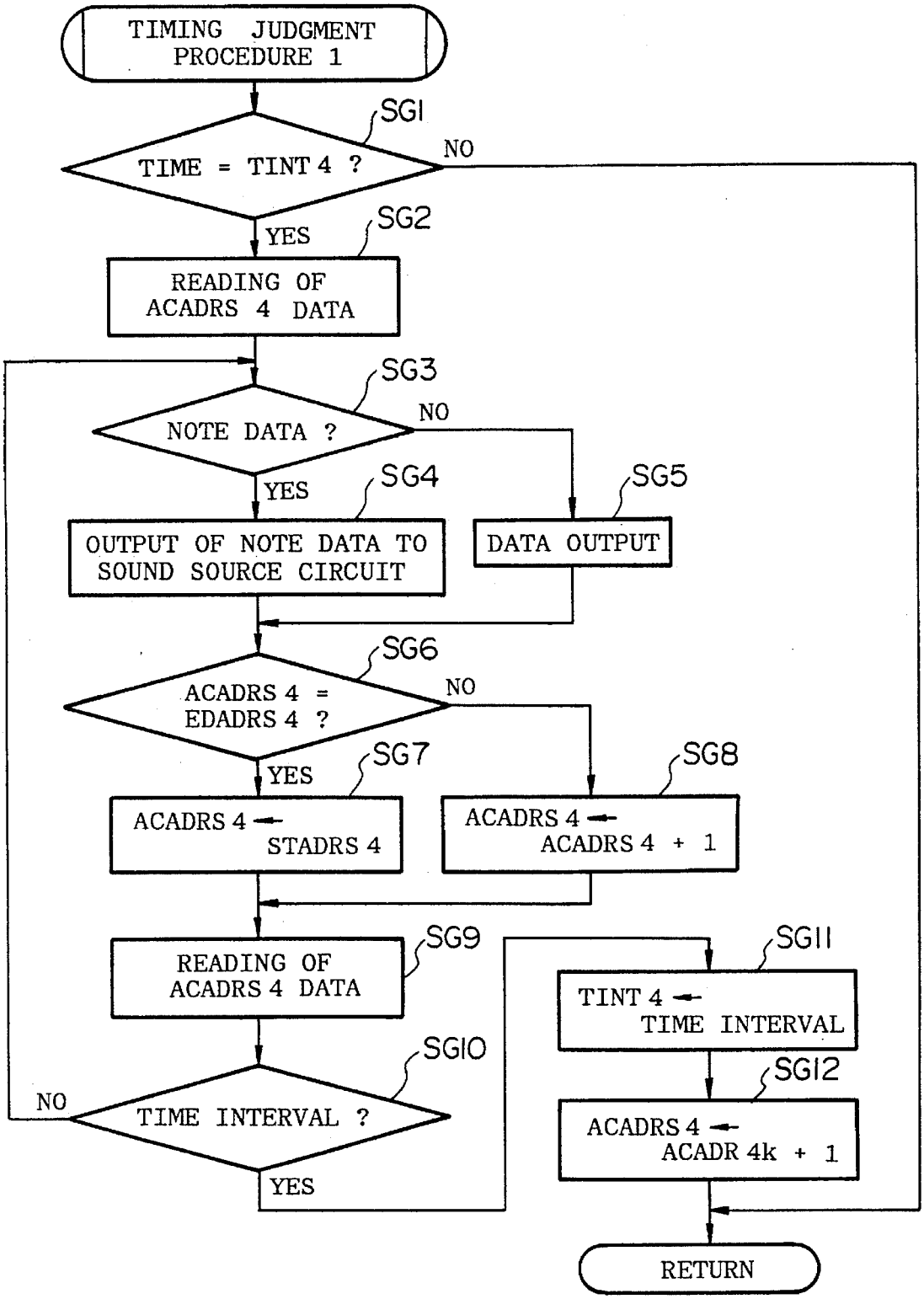

In FIG. 11, the routine for the timing Judgment procedure 1 is shown. In step SG1 of this routine, Judgment is made as to whether or not the value of register TIME equals to the value of register TINT4, which stores the rhythm start addresses designated by the performer as the data for accompaniment in the rhythm start/stop switch procedure routine (see FIG. 7). When the result of judgment in step SG1 is [NO], namely, when the value of register TIME does not equal the value of register TINT4 because it is not the timing for the rhythm to be played, nothing is performed as the routine returns to the automatic accompaniment procedure routine in FIG. 10, and step SF5 is proceeded to.

In contrast, when the result of judgment in step SG1 is [YES], or in other words when the value of register TIME equals the value of register TINT4 because it is the timing for the rhythm to be played, step SG2 is proceeded to.

In step SG2, the data stored in the address of the automatic accompaniment data area (see FIG. 3 (1)) corresponding to the value of register ACADRS4, namely the event, is read. This procedure is carried out by reason that after the timing interval is read from the address of the automatic accompaniment data area corresponding to the value of register ACADRS4 in the procedures of the above-described rhythm start/stop switch procedure routine steps SC7 and SC8, the value of register ACADRS4 is incremented by 1 such that the address of the automatic accompaniment data area corresponding to the register ACADRS4, in this occasion, is the event corresponding to this timing interval. Then, the routine proceeds to step SG3.

In step SG3, judgment is made as to whether or not the data read is a note data. When the result of judgment in step SG3 is [YES], step SG4 is proceeded to. In step SG4, after the note data is outputted to sound source circuit 10, step SG6 is proceeded to.

However, when the result of Judgment in step 3 is [NO], or in other words when the data read is not a note data, step SG5 is proceeded to.

In step SG5, this data (for example a bar line data) is outputted. This bar line data, for example, can be used in the way outlined below. A bar counter is provided which is not shown in the figures, which counts up every time a bar line data is outputted. The value of this counter is displayed in display circuit 9. The routine then proceeds to step SG6. In step SG6 judgment is made as to whether or not the value of register ACADRS4 equals the value of register EDADRS4. When the result of judgment in step SG6 is [YES], that is, the value of register ACADRS4 is equal to the value of register EDADRS4. The rhythm sounds are performed until the end of the ABC pattern, or in other words until the part designated by the performer. Following this, step SG7 is proceeded to.

In step SG7, the value of register STADRS4 is stored in register ACADRS4, after which step SG9 is proceeded to. Conversely, when the result of judgment in step SG6 is [NO], namely when the value of register ACADRS4 does not equal the value of register EDADRS4 and the rhythm sounds are not performed until the end of ABC pattern, or in other words, the rhythm sounds are not performed until the portion designated by the performer, step SG8 is proceeded to. In step SG8, after the value of register ACADRS4 has been incremented by 1, step SG9 is proceeded to. In step SG9, after the data stored in the automatic accompaniment data area address corresponding to the value of register ECADRS4 is read, step SG10 is proceeded to.

In step SG10 judgment is made as to whether or not the data read is a time interval. When the result of judgment in step SG10 is [NO], step SG3 is returned to. This type of result occurs in the case when at one timing, two or more sounds come out at the same time.

However, when the result of Judgment in step SG10 is [YES], the data read is a time interval, and step SGll is proceeded to. In step SG11, once the time interval read is stored in register TINT4, step SG12 is proceeded to. In step SG12, after the value of register ACADRS4 is incremented by 1, the automatic accompaniment procedure routine in FIG. 10 is returned to, proceeding to step SF5.

Figure 12:
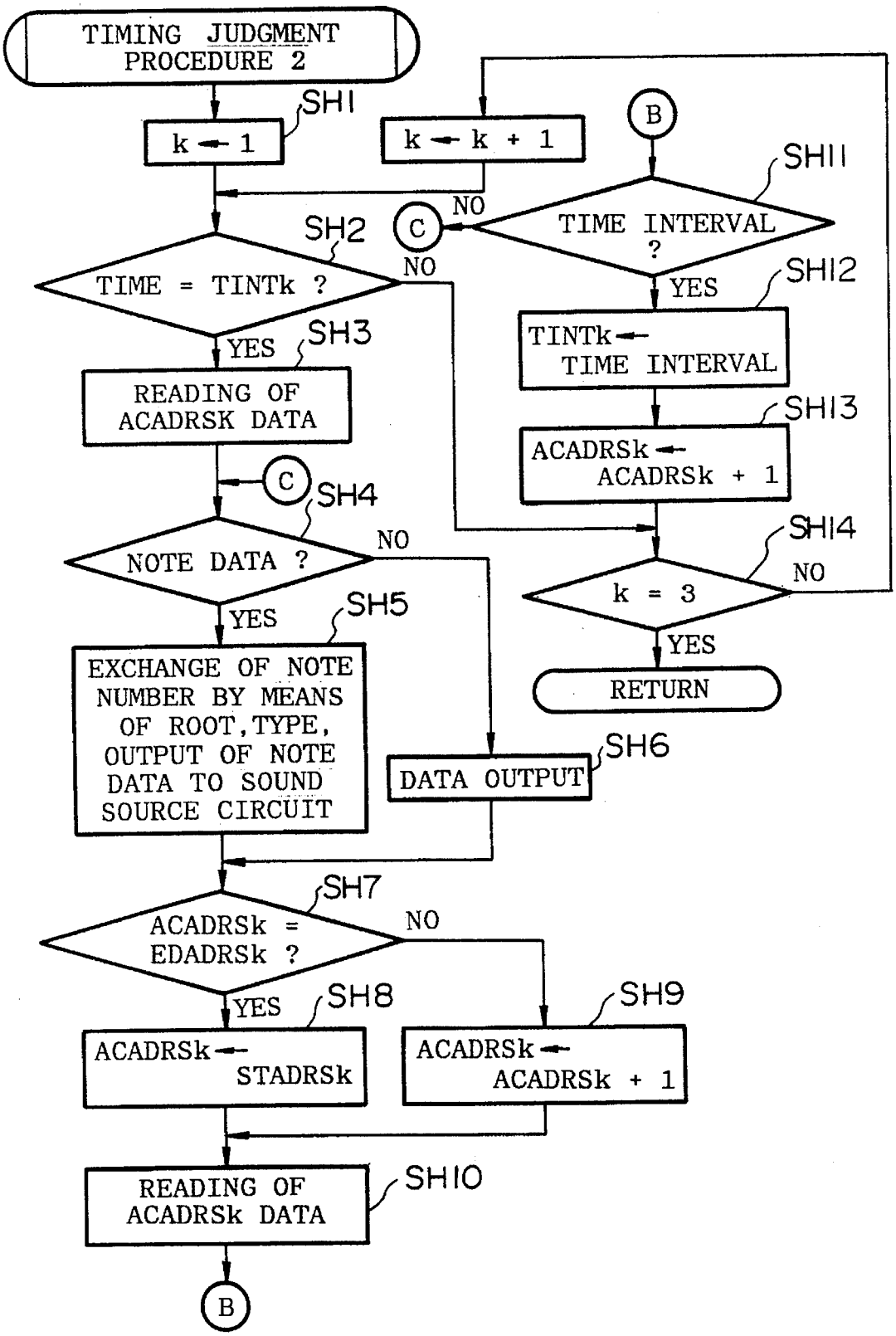

The routine of the timing Judgment procedure 2 is shown in FIG. 12. In step SH1 of this routine, 1 is stored in variable register k employed for processing chords 1, 2 and bass, which are stored in the automatic accompaniment data area tracks 5–7 shown in FIG. 3, after which step SH2 is proceeded to. In step SH2 judgment is made as to whether or not the value of register TIME equals to the value of register TINT1 which in this case, stores the start address of chord 1 designated by the performer as the data for accompaniment in rhythm start/stop switch procedure routine (see FIG. 7). When the result of judgment in step SH2 is [YES], namely, when in order for the timing to play chord 1, the value of register TIME is equal to the value of register TINT1, the routine proceeds to step SH3.

In step SH3, after the value in register ACADRSk, which in this case is the data stored in the automatic accompaniment data area address (see Flg. 3 (1)) corresponding to the value of register ACADRS1, which is the event, is read, step SH4 is proceeded to. In step SH4 judgment is made as to whether or not the data read is a note data. When the result of the judgment in step SH4 is [YES], step SH5 is proceeded to.

In step SH5, reference is made to an exchange table by using the root ROOT and type TYPE of the above mentioned note data. In this manner, the note number of the note data is exchanged for a fixed note number; after the note data containing this exchanged note number is outputted to the sound source circuit 10, and step SH7 is proceeded to.

In contrast, when the result of Judgment in step SH4 is [NO], namely when the data read is not a note data, step SH6 is proceeded to. In step SH6, after that data is outputted, step SH7 is proceeded to. In step SH7 Judgment is made as to whether or not the value of register ACADRSk equals the value of register EDADRSk, or in this case, whether or not the value of register ACADRS1 equals the value of register EDADRS1. When the result of judgment in step SH7 is [YES], namely when the value of register ACADRS1 equals the value of register EDADRS1 and in the case when the sounds of chord 1 are played until the end of ABC pattern, or in other words the sounds are played until the portion designated by the performer, step SH8 is proceeded to. In step SH8, the value of register EDADRSk is stored in register ACADRSk, and in this case the value of register STADRS1 is stored in register ACADRS1, and step SH10 is proceeded to.

In contrast, when the result of Judgment in step SH7 is [NO], that is, when the value of register ACADRSk does not equal the value of register EDADRSk, in this case, the value of register ACADRS1 does not equal the value of register EDADRS1 and the sounds of chord 1 are not played until the end of an ABC pattern, in other words the sounds are not played until the portion designated by the performer. Following this, step SH9 is proceeded to.

In step SH9 the value of register ACADRSk, in this case the value of register ACADRS1, is incremented by 1, after which step SH10 is proceeded to. In step SH10, the data stored in the automatic accompaniment data area address corresponding to the value of register ACADRSk, in this case register ACADRS1, is read, after which step SH11 is proceeded to. In step SH11 judgment is made as to whether or not the data read is a time interval. When the result of judgment in step SH11 is [NO], step SH4 is returned to.

However, when the result of judgment in step SH11 is [YES], that is, when the data read is a time interval, step SH12 is proceeded to. In step SH12, after the time interval read has been stored in register TINTk, in this case register TINT1, step SH13 is proceeded to. In step SH13, after the value of register ACADRSk, in this case register ACADRS1, is incremented by 1, step SH14 is proceeded to. Additionally, when the result of judgment in step SH2 is [NO], namely when it is not the timing which generates chord 1 and thus the value of register TIME does not equal the value of register TINT1, step SH14 is proceeded to.

In step SH14, judgment is made as to whether or not the value of the variable register k is 3, that is, the judgment is made as to whether or not the procedures of the above mentioned step SH2–13 have been brought to an end in regards to chords 1, 2 and bass. When the result of Judgment in step SH14 is [YES], or in other words When the procedure creating chords 1, 2 and bass is has been brought to an end, the routine returns to the automatic accompaniment procedure routine in FIG. 10, proceeding to step SF5.

In contrast, when the result of judgment in step SH14 is [NO], namely when the procedure creating chords 1, 2 and bass has not yet been brought to an end, step SH15 is proceeded to. In step SH15, after the value of the variable register k is incremented by 1, step SH2 is returned to.

By carrying out the above explained procedure with the value of the variable register k being from 1 to 3 inclusive the procedure which creates chords 1, 2 and bass is brought to an end.

Furthermore, in the above mentioned embodiment, the example is given in which, among the automatic performance data, only one territory of each track is repeated and used in automatic accompaniment, but the present invention is not just restricted to this example. It is also possible to assign and apply a plurality of regions of the automatic performance data as, for example, patterns for an introduction, a fill-in, or an ending. In this case, it is also possible to mix and use a pattern previously stored in ROM, and the pattern which the performer creates by means of the above mentioned embodiment. For example, the ROM data can be used in normal patterns, while the introduction can be used in created patterns. Additionally, in the above mentioned embodiment, an example is given in which among the automatic performance data, only chord 1, 2, base, and rhythm are used in automatic accompaniment patterns. However, melody can also be used and chord, bass, and rhythm can each be used separately.

Furthermore, in the above mentioned embodiment, an example was given in which after assuming there was a C major, note numbers of the automatic accompaniment data were changed based on the root ROOT and type TYPE of the chord. But it is also possible that tonality of the pattern of the automatic accompaniment data is judge, when the note number of the automatic accompaniment data is changed to the note number suitable to C major and the note number in the pattern is changed based on the root ROOT and type TYPE of the chord. In this way, no matter what kind of data is stored in the automatic performance data area, the pattern will not become unnatural.

Therefore, in the above mentioned embodiment, an example is given in which the automatic performance data is used as an automatic accompaniment pattern by means of controlling only the automatic performance data area address. However, once the data for use in automatic accompaniment is entered in another RAM it is also possible to use the entered data once it is read out as an automatic accompaniment pattern.

Additionally, in the above mentioned embodiment, an example is given in which the automatic accompaniment pattern is used in bar units. However, it is not 11 limited to this as it is also possible to designate optional positions of the automatic performance data area and use these as well.

Furthermore, in the above mentioned embodiment, an example is given in which among the automatic performance data, each part of chords 1,2, base, and rhythm, which are all of the same region, are used in automatic accompaniment patterns. However, it is also possible to use different regions by means of each part. For example, among the automatic performance data, it is also possible to use as automatic accompaniment patterns, chord 1 for the first bar, chord 2 for the second bar, bass for the third bar, and rhythm for the fourth bar. In this case, it is also possible to control the transfer of such things as tempo and tone color stored in header 1 of the automatic performance data. By transferring these tempos and tone colors, an automatic accompaniment suitable to the musical composition becomes possible.

What is claimed:

1. An electronic musical instrument comprising:

storage means for storing automatic performance data representing a piece of music, the automatic performance data being identified by logical addresses;

designation means for designating an arbitrary region of data from among said automatic performance data by designating a head address and an end address at any position among the logical addresses in response to user input, the arbitrary region of data representing a part of the piece of music; and automatic accompaniment means for repeatedly reading out the arbitrary region of data from said storage means based on the head address and the end address and for performing a desirable automatic accompaniment by using the read out arbitrary region of data.

2. An electronic musical instrument according to claim 1, wherein said automatic performance data is selected from a group consisting of melody data, chord pattern data, bass pattern data and rhythm pattern data.

3. An electronic musical instrument according to claim 1, wherein said designation means designates said arbitrary region of data among said automatic performance data by bar units.

4. An electronic musical instrument according to claim 1, wherein said automatic accompaniment means includes start designation means for designating a start of the automatic accompaniment and repeated reading out of said arbitrary region of data among said automatic performance data.

5. An electronic musical instrument according to claim 1, wherein said automatic accompaniment means reads out said arbitrary region of data among said automatic performance data from the head address to the end address repeatedly.

6. An electronic musical instrument according to claim 1, wherein said automatic performance data comprises a plurality of parts, and said designation means designates said arbitrary region of data among said automatic performance data independently for each part.

7. An electronic musical instrument according to claim 1, further comprising:

music designating means for designating a plurality of regions in the piece of music;

read designating means for designating a plurality of arbitrary regions of automatic performance data to be read; an corresponding means for corresponding each arbitrary region of automatic performance data and each region of the piece of music, wherein the automatic accompaniment means reads the arbitrary regions of automatic performance data in order of the regions of the piece of music by operation of the read designating means.

8. An electronic musical instrument comprising:

storage means for storing automatic performance data representing a piece of music, the automatic performance data being identified by logical addresses;

designation means for designating an arbitrary region of data from among said automatic performance data by designating a head address and an end address among the logical addresses in response to user input, the arbitrary region of data representing a part of the piece of music;

automatic accompaniment means for repeatedly reading out the arbitrary region of data from said storage means based on the head address and the end address and for performing a desirable automatic accompaniment by using the read out arbitrary region of data;

chord designation means for designating a chord of automatic accompaniment data to the automatic accompaniment means; and translation means for translating the automatic performance data in the arbitrary region based upon the chord.

9. An electronic musical instrument according to claim 8, wherein said chord designation means includes a plurality of keys;

detection means for detecting the state of a depressed key; and second translation means for translating the state of the depressed key to chord data.

10. An electronic musical instrument comprising:

a storage device for storing a series of automatic performance data representing a piece of music;

a designation circuit for designating an arbitrary region of data from among said series of automatic performance data by designating a start point and an end point at any position among the series of automatic performance data, with the arbitrary region of data representing a part of the piece of music; and an automatic accompaniment circuit for reading out the arbitrary region of data from said start point to said end point from the storage device, and for carrying out a desirable automatic accompaniment using the arbitrary region of data read out from among the series of automatic performance data.

11. An electronic musical instrument according to claim 10, wherein said automatic performance data is selected from a group consisting of melody data, chord pattern data, bass pattern data and rhythm pattern data.

12. An electronic musical instrument according to claim 10, wherein said designation circuit designates said arbitrary region of data among said automatic performance data by bar units.

13. An electronic musical instrument according to claim 10, further comprising chord designation circuit for designating a chord of automatic accompaniment data to the automatic accompaniment circuit.

14. An electronic musical instrument according to claim 13, wherein said chord designation circuit comprises:

a plurality of keys;

a detection circuit for detecting the state of a depressed key; and a translation circuit for translating the automatic performance data in the arbitrary region based upon the chord.

15. An electronic musical instrument according to claim 10, wherein said automatic accompaniment circuit includes a start designation circuit for designating a start of the automatic accompaniment and repeated reading out of the arbitrary region of data among said automatic performance data.

16. An electronic musical instrument according to claim 10, wherein said automatic accompaniment circuit reads out said arbitrary region of data among said automatic performance data from the head address to the end address repeatedly.

17. An electronic musical instrument according to claim 10, wherein said automatic performance data comprises a plurality of parts, and said designation circuit designates said arbitrary region of data among said automatic performance data independently for each part.

18. An electronic musical instrument according to claim 10, further comprising:

a music designating circuit for designating a plurality of regions in the piece of music;

a read designating circuit for designating a plurality of arbitrary regions of automatic performance data to be read;

a corresponding circuit for corresponding each arbitrary region of automatic performance data and each region of the piece of music, wherein the automatic accompaniment circuit reads the arbitrary regions of automatic performance data in order of the regions of the piece of music by operation of the read designating circuit.

19. A method of playing an electronic musical instrument comprising the steps of:

storing a series of automatic performance data representing a piece of music;

designating an arbitrary region of data from among said series of automatic performance data by designating a start point and an end point at any position among the series of automatic performance data, with the arbitrary region of data representing a part of the piece of music;

reading out the arbitrary region of data from said start point to said end point; and carrying out a desirable automatic accompaniment using the arbitrary region of data read out from among the series of automatic performance data.

20. A method according to claim 19, further comprising the steps of:

designating a plurality of regions in the piece of music;

designating a plurality of arbitrary regions of automatic performance data;

corresponding each arbitrary region of automatic performance data and each region of the piece of music; and reading the arbitrary regions of automatic performance data in order of the regions of the piece of music.

* * * * *